United States Patent [19]

Kobayashi

[11] Patent Number: 4,754,971

[45] Date of Patent: Jul. 5, 1988

[54] GOLF CLUB SET

[75] Inventor: Masashi Kobayashi, Matsudo, Japan

[73] Assignee: Maruman Golf Co., Ltd., Tokyo, Japan

[21] Appl. No.: 887,474

[22] Filed: Jul. 21, 1986

[30] Foreign Application Priority Data

Jul. 22, 1985 [JP] Japan ..... 60-160319

[51] Int. Cl.[4] ..... A63B 53/04; A63B 53/08

[52] U.S. Cl. ..... 273/77 A; 273/175

[58] Field of Search ..... 273/77 A, 173, 174, 273/167 J, 175, 167 R, 169, 170, 171, 172, 77 R, 78

[56] References Cited

U.S. PATENT DOCUMENTS

| | | | |
|---|---|---|---|
| 3,455,558 | 7/1969 | Onions | 273/77 A |
| 3,966,210 | 6/1976 | Rozmus | 273/167 J |
| 3,989,861 | 11/1976 | Rasmussen | 273/167 J |
| 4,529,203 | 7/1985 | Ribaudo | 273/173 |
| 4,630,826 | 12/1986 | Nishigaki et al. | 273/173 X |

FOREIGN PATENT DOCUMENTS

| | | | |
|---|---|---|---|
| 21938 | 2/1977 | Japan | 273/173 |
| 52-81254 | 5/1977 | Japan | 273/77 A |
| 55-34835 | 3/1980 | Japan | 273/77 A |
| 61-272067 | 12/1986 | Japan | 273/77 A |
| 1192139 | 5/1970 | United Kingdom | 273/167 J |

*Primary Examiner*—George J. Marlo

*Attorney, Agent, or Firm*—Armstrong, Nikaido, Marmelstein & Kubovcik

[57] ABSTRACT

A set of golf clubs, each having a striking surface with a different angle of loft and a coefficiency of friction. The coefficient of friction gradually increases in accordance with a gradual decrease of the angle of loft and a gradual increase of the club length. Therefore, the longer the club is, the smaller the angle of loft of the club and the larger the coefficient of friction becomes. It is easy to provide a back spin on a ball even with a longer club.

4 Claims, 6 Drawing Sheets

GOLF CLUB SET

BACKGROUND OF THE INVENTION

1. Field of the Invention

The present invention relates to a set of matched golf clubs of varying club-numbers having club-length, head-loft and head-weight characteristics such that the club-length decreases gradually and the head-loft and head-weight increases gradually in accordance with a gradual increase of the club-number, and more particularly, to a set of matched golf clubs of varying club-numbers in which each of the golf clubs can obtain a trajectory of flight of a ball and a distance of subsequent run thereof which are suitable for players with different swing styles.

2. Description of the Prior Art

Generally, a conventional set of iron or wood golf clubs of varying club-numbers has club-length, head-loft and head-weight characteristics by which the club-length decreases gradually or regularly and the head-loft and head-weight increases gradually or regularly, in accordance with a gradual increase of the club-number. However, the front surfaces of the club heads in a conventional set of the golf clubs are made to have the same characteristic. For example, in a conventional set of wood golf clubs, front surfaces of the club heads are generally provided with face-inserts, respectively, which are made of the same material such as ABS resin, paper fibers, aluminum alloy, titanium, fiber-reinforced plastic or the like, and outer surfaces of the face-inserts are finished to have the same characteristic. On the other hand, in a conventional set of iron golf clubs, club heads are generally made of the same material such as iron, stainless steel, fiber-reinforced plastic or the like, and front surfaces of the club heads are finished to have the same characteristic.

Generally, a trajectory of flight of a ball and a distance of subsequent run thereof are affected by the amount of back spin, an initial flying angle, and an initial flying velocity of the ball hit by the club head. Therefore, for example, in order to obtain a high trajectory of flight of a ball and a short distance of subsequent run thereof, it is necessary to increase the amount of back spin, an initial flying angle, and an initial flying velocity of the ball. In turn, in order to obtain a low trajectory of flight of a ball and a long distance of subsequent run thereof, it is necessary to increase an initial flying velocity of the ball and decrease the amount of back spin of the ball, as well as the angle at which the ball falls to the ground.

The head-loft of the golf club is an essential factor for determining the amount of back spin of a ball, trajectory of flight of a ball, and distance of subsequent run thereof and, as described above, the head-loft characteristic in the conventional set of golf clubs is determined so that the head-loft increases gradually in accordance with a gradual increase of the club-number. Therefore, when using a conventional set of golf clubs, the amount of back spin of a ball generally tends to increase in accordance with the increase of the club-number. However, in actual play, the amount of back spin of the ball is also affected by the various swing styles or personal habits of players. Therefore, the above-mentioned conventional set of the golf clubs in which front surfaces of the club heads have the same characteristic has a disadvantage in that all or some of the golf clubs in the set of the golf clubs may give too much or too little back spin to a ball, due to the various swing styles of the players.

It is possible to adjust the head-loft of each of the golf clubs so as to get a suitable amount of back spin on a ball. But, in order to provide club heads with several head-lofts under the same club-number, it is necessary to provide many different molds for club heads of the same club-number, and this results in a high manufacturing cost.

SUMMARY OF THE INVENTION

The present invention is a set of plural golf clubs with different club lengths, said golf clubs having striking surfaces with different angles of loft and coefficients of friction in a manner such that the coefficients of friction gradually increase in accordance with a gradual decrease of the angle of loft and a gradual increase of the club length.

According to the present invention, a method is provided of producing a set of matched golf clubs of varying club-numbers having club-length, head-loft and head-weight characteristics such that the club-length decreases gradually and the head-loft and head-weight increases gradually in accordance with a gradual increase of the club-number, comprising the steps of:

- determining a coefficient of friction of each of the front surfaces of the club heads for the set of matched golf clubs;
- applying a surface treatment to each of the front surfaces of the club heads for the set of matched golf clubs so that the coefficient of friction of each of the front surfaces becomes substantially consistent with a predetermined value; and
- securing the club heads to which the surface treatment has been applied and grip members to a series of shafts for the set of matched golf clubs, respectively.

In accordance with the above-mentioned method, it is possible to easily obtain a set of matched golf clubs in which each of the front surfaces of the club heads has a proper coefficient of friction, and thus each of the golf clubs can give a suitable amount of back spin to a ball, without providing variable molds for the same club-number. Therefore, according to the present invention, it is possible to easily and cheaply provide a set of matched golf clubs in which each of the golf clubs can give a trajectory of flight of a ball and a distance of subsequent run thereof most suitable for individual players with different swing styles.

The coefficient of friction of each of the front surfaces of the club heads may be determined so that the coefficient of friction thereof increases gradually or decreases gradually in accordance with a gradual increase of the club-numbers in the set of matched golf clubs.

A sandblast treatment may be applied to each of the front surfaces of the club heads so that the coefficient of friction of each of the front surfaces of the club heads becomes substantially consistent with a predetermined value. Alternatively, a plurality of grooves may be formed in each of the front surfaces of the club heads, or materials selected to have a predetermined coefficient of friction may be coated on the front surfaces of the club heads, respectively.

BRIEF EXPLANATION OF THE DRAWINGS

The foregoing and other features and advantages of the present invention will be more apparent from the following detailed description with reference to the preferred embodiments illustrated in the drawings; wherein FIGS. 1(*a*) to 1(*d*) are partial perspective views of iron golf clubs with successive club-numbers, respectively, in the set of matched iron golf clubs according to a first embodiment of the present invention;

FIG. 1(*f*) is a sectional view, taken at II—II, FIG. 1(*d*) showing a club front surface roughened with an adhesive spray.

FIG. 2(*e*) is a sectional view, taken at III—III, FIG. 2(*d*) showing the grooved surface.

DETAILED DESCRIPTION OF THE INVENTION

Figure 1:
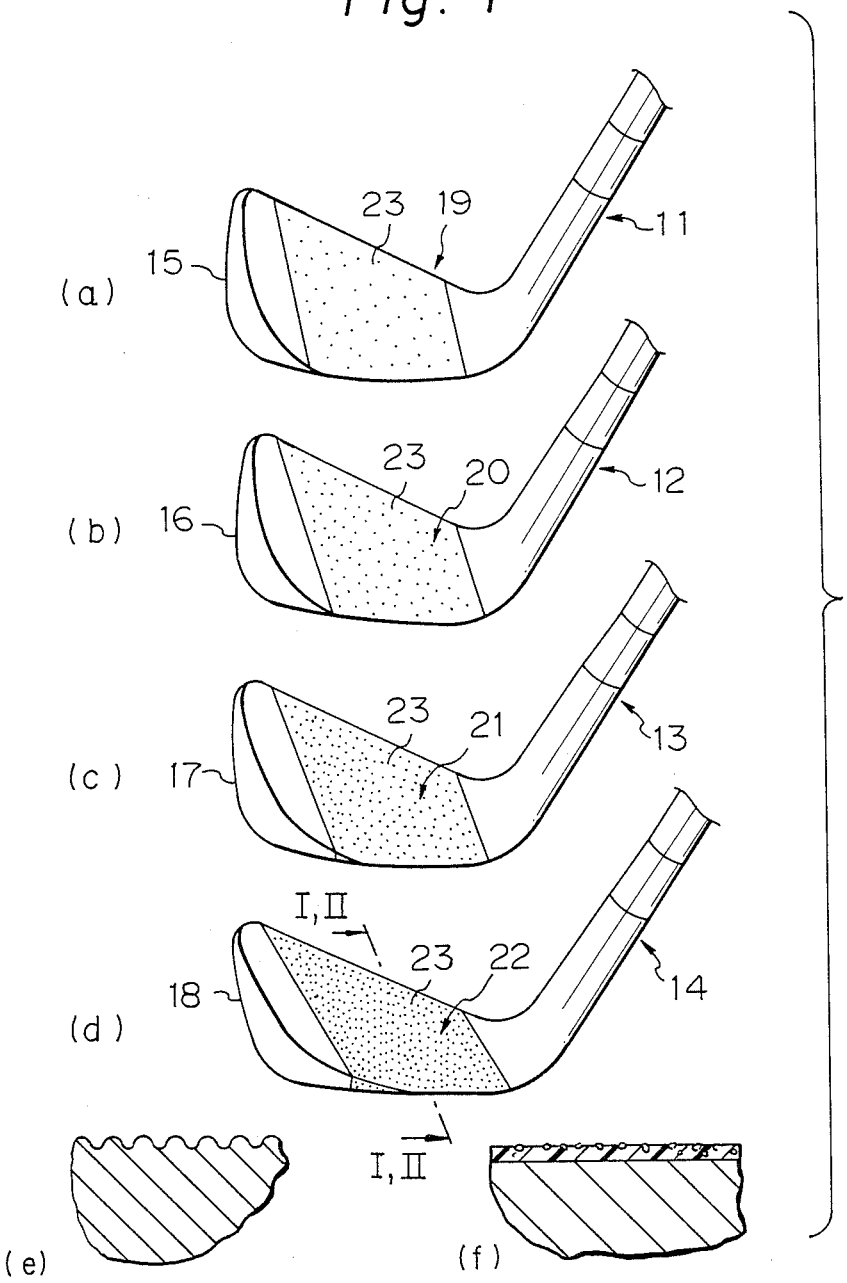
FIG. 1(*e*) is a sectional view, taken at I—I, FIG. 1(*d*) showing a sandblasted roughened club front surface.

FIGS. 1(*a*) to 1(*d*) show successive iron golf clubs 11 to 14, respectively, which are a part of one set of matched iron golf clubs of varying club-numbers according to one embodiment of the present invention. The set of iron golf clubs according to the present invention generally consists of eight iron golf clubs with club-numbers two through nine and a pitching wedge as a number ten club. The set of iron golf clubs may additionally include a sand wedge as a number eleven club. Further, a set of iron golf clubs according to the present invention may be a so-called half-set consisting of four iron clubs numbers three, five, seven and nine and a pitching wedge as a number eleven club.

The set of the iron golf clubs including the golf clubs 11 to 14 shown in FIGS. 1(*a*) to 1(*d*) has club-length, head-loft and head-weight characteristics in which the club-length decreases gradually or regularly and the head-loft and head-weight increases gradually or regularly in accordance with a gradual increase of the club-number.

Referring to FIGS. 1(*a*) to 1(*d*), the iron golf clubs 11 to 14 have club heads 15 to 18 secured to the tip end of shafts, respectively. The club heads 15 to 18 of the iron clubs 11 to 14 have front surfaces 19 to 22, respectively, for contacting a ball. In this embodiment, each of the front surfaces 19 to 22 of the club heads 15 to 18 is formed with many fine irregularities 23 made by a sandblasting treatment, FIG. 1(*e*). The roughnesses of each of the front surfaces 19 to 22 upon the fine irregularities 23 is determined so that the roughness increases gradually or regularly in accordance with a gradual increase of the club-number. Such a roughness characteristic exists in the whole of the set of the iron golf clubs including the above-mentioned four clubs 11 to 14, and thus the coefficient of friction of each of the front surfaces of the club heads in the set of the golf clubs is determined so that the coefficient of friction increases gradually or regularly in accordance with a gradual increase of the club-number. In order to obtain such a roughness characteristic, it is preferable to change the size of the sand-particles used in the sandblast treatment for the club heads so that the size of the sand-particles increases in accordance with an increase of the club-number.

Figure 2:
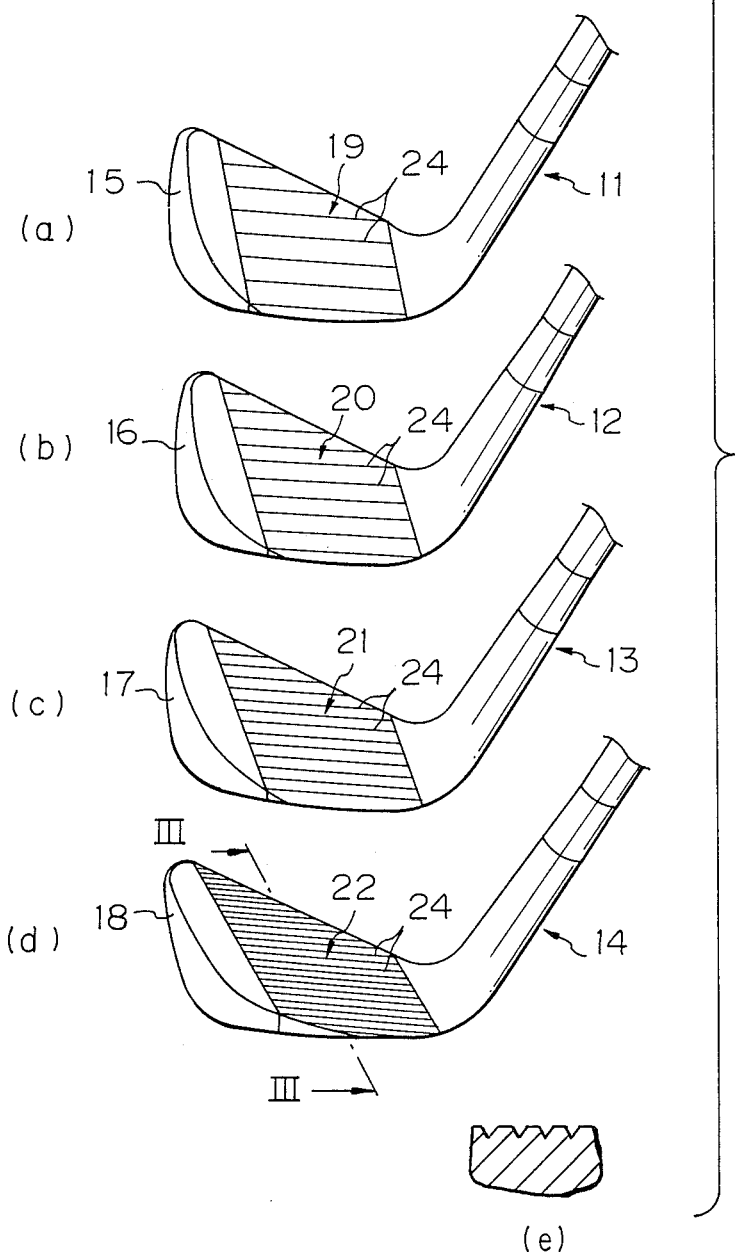
FIGS. 2(*a*) to 2(*d*) are partial perspective views of four iron golf clubs with successive club-numbers, respectively, in the set of matched iron golf clubs according to a second embodiment of the present invention.

FIGS. 2(*a*) to 2(*d*) show a part of the set of matched iron golf clubs of varying club-numbers according to a second embodiment of the present invention. In these Figures, constitutional elements the same as in the above-mentioned embodiment bear the same reference numerals. In the second embodiment, the front surfaces 19 to 22 of the club heads 15 to 18 of the iron golf clubs 11 to 14 are formed with a plurality of grooves 24, respectively, extending in parallel to each other between the toe side and the heel side of each of the club heads 11 to 14, FIG. 2(*e*). The number of grooves 24 in each of front surfaces of the club heads is determined so that the number of grooves increases gradually in accordance with a gradual increase of the club-number. Such a characteristic of the number of grooves exists in the whole of the set of the iron golf clubs including the iron golf clubs shown in FIGS. 2(*a*) to 2(*d*). Therefore, the coefficient of friction of each of the front surfaces of the club heads in the set of the iron golf clubs is determined so that the coefficient of friction increases gradually or regularly in accordance with a gradual increase of the club-number.

Alternately, each of the front surfaces of the club heads in the set of the iron golf clubs of varying club-numbers may be coated with material selected to have a predetermined coefficient of friction by, for example, an adhesive or thermal spraying or the like, FIG. 1(*f*). Various materials having various magnitudes of coefficient of friction, such as polytetrafluoroethylene having a low coefficient of friction, ceramic having a high coefficient of friction or the like, may be selected so that the coefficient of friction increases gradually or decreases gradually in accordance with a gradual increase of the club-number.

Figure 3:
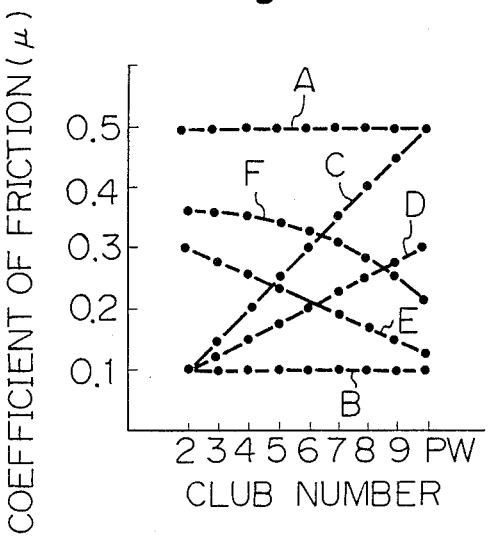
FIG. 3 is a chart schematically showing, as examples, six kinds of predetermined club number-coefficient of friction characteristics for a set of nine iron golf clubs, according to the present invention.

FIG. 3 schematically shows, as examples, six kinds of predetermined club number-coefficient of friction characteristic lines denoted by reference characters A through E for a set of nine iron golf clubs of varying club-numbers, including iron golf clubs numbers two through nine and a pitching wedge as a number ten club.

When a straight line A or B shown in FIG. 3 has been selected in order to determine the coefficient of friction of each of the front surfaces of the club heads to be produced, the front surfaces of the club heads of the set of the iron golf clubs according to the present invention have a fixed coefficient of friction of 0.5 or 0.1.

Similarly, when a straight line C, D or E or a curved line F has been selected, the set of the iron golf clubs of varying club-numbers according to the present invention has a characteristic in regard to the coefficient of friction of each of the front surfaces of the club heads such that the coefficient of friction varies successively or gradually in accordance with a gradual increase of the club-number.

Particularly, when the straight line C or D has been selected, the set of the iron golf clubs of varying club-numbers according to the present invention has a characteristic in regard to the coefficient of friction of each of the front surfaces of the club heads such that the coefficient of friction increases linearly at a certain ratio in accordance with a gradual increase of the club-number.

Further, when the straight line E has been selected, the set of the iron golf clubs of varying club-numbers according to the present invention has a characteristic in regard to the coefficient of friction of each of the front surfaces of the club heads such that the coefficient of friction decreases linearly at a certain ratio in accordance with a gradual increase of the club-number.

Furthermore, when the curved line F has been selected, the set of the iron golf clubs of varying club-numbers according to the present invention has a characteristic in regard to the coefficient of friction of each of the front surfaces of the club heads such that the coefficient of friction decreases nonlinearly in accordance with a gradual increase of the club-number.

According to the present invention, a relationship between the club-number and the coefficient of friction of each of the front surface of the club heads for the set of the iron golf clubs of varying club-numbers is first determined as shown in FIG. 3, and the front surfaces of the club heads for the set are then treated so that the coefficient of friction of each of the front surfaces becomes consistent with the predetermined value by a method as described above, and then the club heads and grip members (not shown) are secured to the series of shafts for the set by a common manner.

Figure 4:
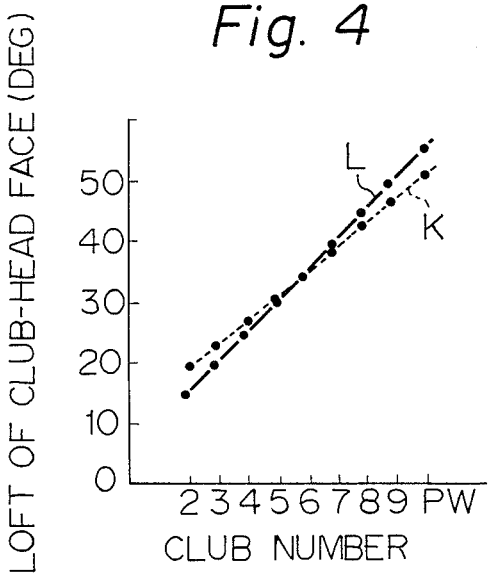
FIG. 4 is a chart schematically showing, as an example, two kinds of predetermined club number-loft of club head characteristics for the set of nine iron golf clubs shown in FIG. 3.

FIG. 4 shows, as examples, two kinds of relationships between the club-number and the head-loft in the set of the iron golf clubs shown in FIG. 3. In FIG. 4, a dotted line denoted by reference character K shows a conventional varying characteristic of the head-loft in which the head-loft increases linearly at a certain ratio in accordance with a gradual increase of the club-number, and a solid line denoted by reference character L shows a similar characteristic in which the head-loft increases linearly at a certain ratio larger than that of the characteristic shown by the dotted line K. The head-loft of each of the club heads for the set of the iron golf clubs according to the present invention may be selected to be consistent with either of the above-mentioned characteristics shown in FIG. 4.

Figure 5:
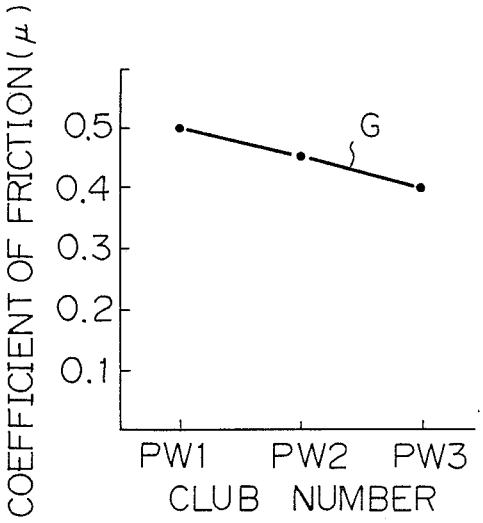
FIG. 5 is a chart schematically showing, as an example, a predetermined club number-coefficient of friction characteristic for a set of three pitching wedges, according to the present invention.
Figure 6:
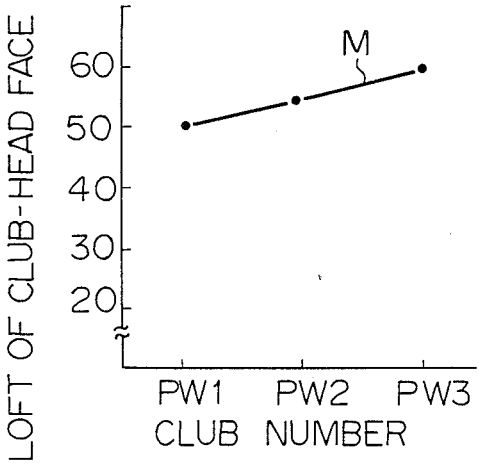
FIG. 6 is a chart schematically showing, as an example, a predetermined club number-loft of club head characteristic for the set of three pitching wedges shown in FIG. 5.
Figure 7:
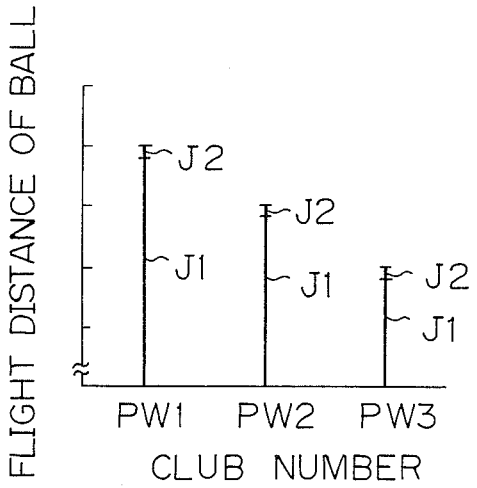
FIG. 7 schematically shows a distance of flight of ball hit by each golf club shown in FIG. 5.

A set of the matched pitching wedges of varying club-numbers may be produced by the above method. FIG. 5 shows, as an example, a predetermined relationship between the club-number and the coefficient of friction for such a set of three pitching wedges. When the front surface of each of the club heads for the set of the pitching wedges is treated by a method as described above so as to be consistent with a characteristic line G shown in FIG. 5, the set has a characteristic such that the coefficient of friction decreases linearly at a certain ratio within the range of 0.5 to 0.4 in accordance with a gradual increase of the club-number. In the case in which the head-loft characteristic of the above-mentioned set of the pitching wedges was determined so that the head-loft increases linearly at a certain ratio within the range of 50 to 60 degrees, as shown by a characteristic line M in FIG. 6, the set of pitching wedges can obtain a characteristic regarding the distance of flight of a ball hit by the pitching wedges as shown in FIG. 7. In FIG. 7, a reference character J1 shows a distance of carry of the ball from a position where the ball was hit to a position where the ball dropped to the ground, and a reference character J2 shows a distance subsequently run by the ball. As apparent from FIG. 7, the set of the pitching wedges PW1 to PW3 according to the present invention has a characteristic regarding the carry and run of the ball such that the carry of the ball decreases at the certain ratio in accordance with a gradual increase of the club-number, but the run of the ball is maintained at a constant distance.

Figure 8:
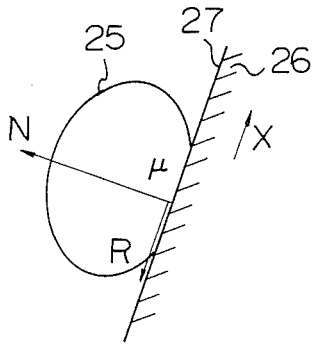
FIG. 8 is a schematic view illustrating directions of an impact force given by a club head to a ball and a force of friction produced between the club head and the ball under a given coefficient of friction of the head when hitting the ball with the club head.

The coefficient of friction generally means a criterion showing a slidability of two objects to each other. In the case of club head of the golf club, when a ball 25 is hit by the golf club 26 as shown in FIG. 8, a ball 25 receives a force N perpendicular to the front surface 27 of the club head 26 from the club head. At this time, the ball 25 moves in a direction of arrow X along the front surface 27 of the club head 26 due to the loft of the club head 26, and thus receives a force R in a direction reverse to the direction of arrow X at a contact surface thereof with the front surface 27 of the club head 26. This force R is a force of kinetic friction and the term "coefficient of friction" used in this description and claims means a ratio $\mu$ of the force of kinetic friction R to force N ($\mu = R/N$).

Figure 9:
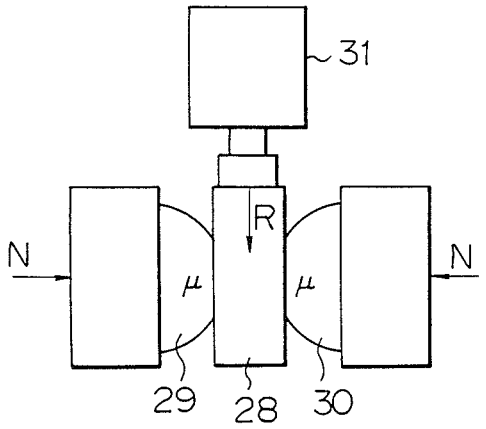
FIG. 9 is a schematic view illustrating, as an example, a device for indirectly measuring a coefficient of friction of a front surface of a club head.

The coefficient of friction $\mu$ can be measured by a method shown in FIG. 9. Referring to FIG. 9, the measurement of the coefficient of friction is effected in such a manner that a test piece 28 to be measured having the same surface condition as that of the club head is provided, and a pair of half-pieces 29 and 30 made by cutting a golf-ball are placed on the opposite sides of the test piece 28. The surface of the test piece 28 is treated together with the club head. Then, the half-pieces 29 and 30 are pushed onto the test piece 28 at a predetermined force N in a direction perpendicular to the side surfaces of the test piece 28, and the test piece 28 is pushed and moved by a load cell 31 in a direction perpendicular to the direction of force N. At this time, a load R given to the test piece 28 by the load cell 31 is measured and a coefficient of friction $\mu$ is calculated by the above-mentioned formula based on the values of load R and force N.

Figure 10:
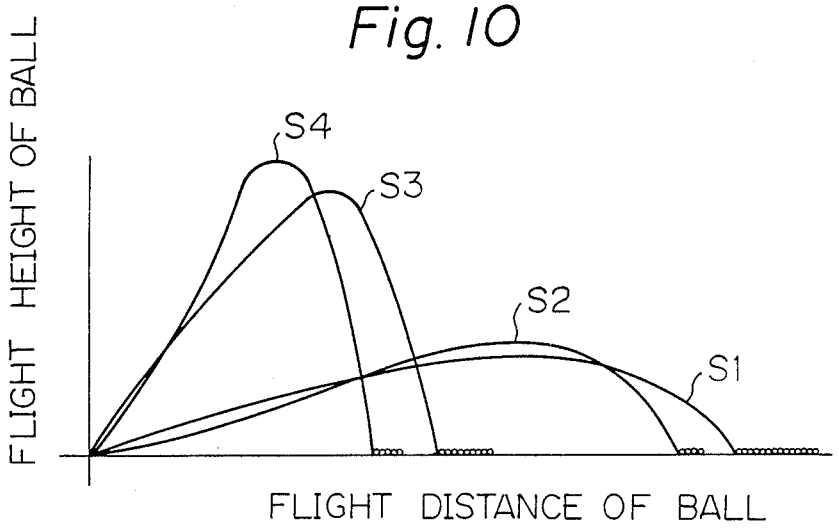
FIG. 10 schematically shows, as examples, four kinds of trajectories of flights and subsequent runs of balls hit by the club heads having different coefficient of frictions.

FIG. 10 schematically shows four kinds of characteristics denoted by reference characters S1 to S4 regarding the trajectory of flight of a ball and subsequent run thereof upon the hitting the balls by individual iron golf clubs. Referring to FIG. 10, a first curved line S1 shows a trajectory of flight of a ball hit by a long iron club, that is, a club having a low club-number, having at the front surface of the club head thereof a low coefficient of friction. The first curved line S1 also shows a small initial flying angle of a ball, a low trajectory of flight of the ball, and long distances of flight and subsequent run of the ball due to a small amount of spin on the ball. A second curved line S2 shows a trajectory of flight of a ball hit by a long iron club which has the same characteristic as that of the above-mentioned long iron club except that it has at the front surface of the club head thereof a high coefficient of friction. In comparison with the curved line S1, the second curved line S2 shows a small initial flying angle of a ball, a high trajectory of flight of the ball, and short distances of flight and subsequent run of the ball due to a large amount of spin on the ball, and thus there is an improved stability of a distance of arrival of a ball.

Similarly, in FIG. 10, a third curved line S3 shows a trajectory of flight of a ball hit by a short iron club, that is, a club having a high club-number, having at the front surface of the club head thereof a low coefficient of friction. The third curved line S3 also shows a large initial flying angle of a ball, a low trajectory of flight of the ball, and long distances of flight and subsequent run of the ball due to a small amount on spin of the ball. Further, a fourth curved line S4 shows a trajectory of flight of a ball hit by a short iron club which has the same characteristic as that of the above-mentioned short iron club except that it has a high coefficient of friction at the front surface of the club head. In comparison with the curved line S3, the fourth curved line S4 shows a small initial flying angle of a ball, a high trajectory of flight of the ball, and short distances of flight and subsequent run of the ball due to a large amount of spin on the ball, and thus there is an improved stability of a distance of arrival of a ball.

While particular embodiments shown in the Figures and disclosure of the present invention have been described, it will be understood, of course, that the present invention is not limited thereto, since modifications can be made by those skilled in the art in the light of the foregoing teachings. For example, the present invention can be applied to a method of producing a set of wood golf clubs of varying club-numbers consisting of five wood clubs numbers one through five, or a larger number of wood clubs.

I claim:

1. A set of plural golf clubs with different club lengths, said golf clubs having striking surfaces provided with different angles of loft and different coefficients of friction in manner such that the coefficient of friction gradually increases in accordance with a gradual decrease of the angle of loft and gradual increase of the club lengths.

2. A set of plural golf clubs according to claim 1, wherein said striking surfaces are formed with a plurality of irregularities with different roughnesses in a manner such that the roughness gradually increases in accordance with a gradual decrease of the angle of loft and a gradual increase of the club length.

3. A set of plural golf clubs according to claim 1, wherein said striking surfaces are formed with a plurality of grooves extending in parallel to each other between toe and heel ends of said heads, two adjacent grooves in said striking surfaces defining different distances therebetween in a manner such that the distance between two adjacent grooves gradually decreases in accordance with a gradual decrease of the angle of loft and a gradual increase of the club length so that the coefficient of friction gradually increases in accordance with a gradual decrease of the angle of loft and a gradual increase of the club length.

4. A set of plural golf clubs according to claim 1, wherein said striking surfaces are formed with coated layers with different coefficients of friction in a manner such that the coefficient of friction gradually increases in accordance with a gradual decrease of the angle of loft and a gradual increase of the club length.

* * * * *